US012595712B2

(12) United States Patent
Frankland et al.

(10) Patent No.: US 12,595,712 B2
(45) Date of Patent: Apr. 7, 2026

(54) SUBSEA CONNECTION ENHANCEMENT ASSEMBLY

(71) Applicant: OneSubsea IP UK Limited, London (GB)

(72) Inventors: Jonathan Mark Frankland, Leeds (GB); Scott Ward, Houston, TX (US)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 18/820,378

(22) Filed: Aug. 30, 2024

(65) Prior Publication Data

US 2025/0084717 A1 Mar. 13, 2025

Related U.S. Application Data

(60) Provisional application No. 63/581,989, filed on Sep. 12, 2023.

(51) Int. Cl.
*E21B 33/038* (2006.01)

(52) U.S. Cl.
CPC ..... *E21B 33/038* (2013.01)

(58) Field of Classification Search
CPC ..... E21B 33/038
See application file for complete search history.

(56) References Cited

U.S. PATENT DOCUMENTS 3,321,217 A 5/1967 Ahlstone
3,325,190 A 6/1967 Eckert
4,984,830 A * 1/1991 Saunders ..... E21B 33/038 285/368
5,309,991 A * 5/1994 Watkins ..... E21B 33/03 285/309
5,404,832 A * 4/1995 Hart ..... E21B 33/038 166/96.1
6,035,938 A 3/2000 Watkins
6,138,762 A 10/2000 Sweeney
7,503,391 B2 3/2009 McCanna
8,474,537 B2 7/2013 Voss
8,485,267 B2 7/2013 Nguyen
9,062,513 B2 6/2015 Pallini, Jr.
9,334,705 B1 * 5/2016 Ward ..... E21B 19/002
2005/0001427 A1 1/2005 Liew
2012/0193906 A1 * 8/2012 Alexander ..... F16L 27/047 285/27
2013/0327546 A1 * 12/2013 Rytlewski ..... E21B 17/06 166/123
2015/0114659 A1 * 4/2015 Jahnke ..... F16L 37/62 166/360
2015/0330169 A1 * 11/2015 Coutts, Jr. ..... E21B 33/038 166/85.1

* cited by examiner

*Primary Examiner* — James G Sayre
(74) *Attorney, Agent, or Firm* — Kyle R. Miiller

(57) ABSTRACT

A subsea connector assembly for coupling a spool member to a wellhead member, comprising a connector and a bending moment suppression device coupled to the connector. The connector includes a lock assembly configured to engage a first portion of a wellhead member. The bending moment suppression device is configured to engage a second portion of the wellhead member, wherein the second portion is spaced axially from the first portion.

20 Claims, 8 Drawing Sheets

SUBSEA CONNECTION ENHANCEMENT ASSEMBLY

CROSS-REFERENCE TO RELATED APPLICATIONS

The present application claims priority to U.S. Provisional Application 63/581,989, filed Sep. 12, 2023, the entirety of which is incorporated by reference herein and should be considered part of this specification.

BACKGROUND

The present disclosure relates generally to the field of subsea connection assemblies. Subsea connection assemblies are used in offshore oil and gas operations for coupling a riser to a subsea wellhead. Subsea connection assemblies can experience high bending loads due to the riser extending to the surface. These high bending loads can lead to leaks or failure of the wellhead or subsea connection assembly. Thus, there is a need in the art for improvements in subsea connection assemblies to accommodate high bending loads and separation forces while being mindful of overall footprint and mass of the subsea connection assemblies.

SUMMARY

A subsea connector assembly for coupling a spool member to a wellhead member, comprising a connector and a bending moment suppression device coupled to the connector. The connector includes a lock assembly configured to engage a first portion of a wellhead member. The bending moment suppression device is configured to engage a second portion of the wellhead member, wherein the second portion is spaced axially from the first portion. The bending moment suppression device, includes a housing, a collet, and a first actuator assembly. The housing includes an inner surface defining a bore, the inner surface having a collet actuation profile. The collet is disposed in the bore of the housing, the collet including a plurality of collet fingers engaged with the collet actuation profile, wherein the collet is axially moveable relative to the housing within the bore to move the collet fingers along the collet actuation profile moving the plurality of collet fingers between a disengaged position and an engaged position, and wherein the collet fingers are engaged with the second portion of the wellhead member when in the engaged position. The first actuator assembly is configured to move the collet axially relative to the housing.

A subsea connector assembly for coupling a spool member to a wellhead member, comprising a connector and a bending moment suppression device. The connector includes a lock assembly configured to engage a first portion of a wellhead member. The bending moment suppression device is coupled to the connector configured to engage a second portion of the wellhead member, wherein the second portion is spaced axially from the first portion. The bending moment suppression device includes an actuation ring, a plurality of dogs, and a first actuator assembly. The actuation ring has a profile. The plurality of dogs are movable along the profile between a disengaged position and an engaged position. The first actuator assembly includes at least one actuator configured to rotate the actuation ring relative to the connector to move the plurality of dogs along the profile between the disengaged position and the engaged position, wherein in the engaged position, the plurality of dogs are engaged with the second portion of the wellhead member.

A method for coupling a spool member to a wellhead member, comprising: engaging a first portion of a wellhead member with a lock assembly of a connector; and engaging a second portion of the wellhead member that is spaced axially from the first portion with a plurality of collet fingers of a collet of a bending moment suppression device coupled to an end of the connector, wherein engaging the second portion includes moving the collet of the bending moment suppression device axially with respect to a housing of the bending moment suppression device to move the plurality of collet fingers of the collet into engagement with the second portion of the wellhead member.

BRIEF DESCRIPTION OF DRAWINGS

So that the manner in which the above-recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

The disclosure contemplates that terms such as "couples," "coupling," "couple," and "coupled" may include but are not limited to welding, interference fitting, and/or fastening such as by using bolts, threaded connections, pins, clips, and/or screws. The disclosure contemplates that terms such as "couples," "coupling," "couple," and "coupled" may include but are not limited to integrally forming. The disclosure contemplates that terms such as "couples," "coupling," "couple," and "coupled" may include but are not limited to direct coupling and/or indirect coupling, such as indirect coupling through components such as links.

Aspects of the present disclosure provide systems, apparatus, and methods for accommodating high bending loads and separation forces in subsea connection assemblies for use in subsea wellhead equipment. The present disclosure generally relates to subsea connection assemblies with a reduced footprint and/or reduced size that accommodate high bending loads and separation forces in subsea wellhead connections due to the internal pressure end loads and external tension. In some embodiments, the subsea connection assembly includes a connector with a lock assembly engageable with a first portion of a wellhead member and a bending moment suppression device engagable with a second portion of the wellhead member.

Figure 1:
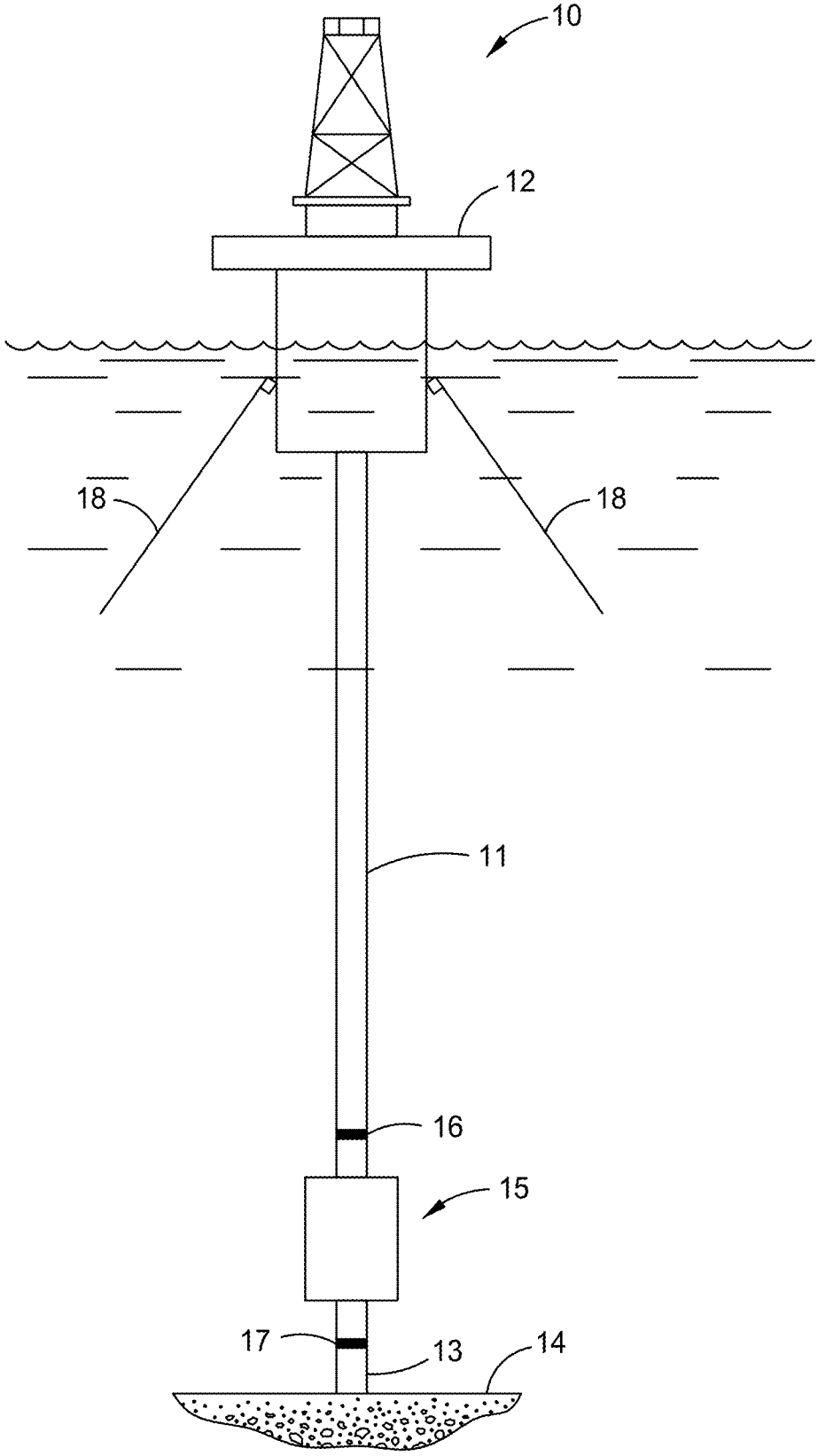
FIG. 1 illustrates a schematic view of an exemplary offshore system, according to one or more embodiments.

FIG. 1 illustrates a schematic view of an exemplary offshore system 10, according to one or more embodiments. The offshore system 10 includes a riser 11 extending between a floating platform 12 and a subsea wellhead 13 at the sea floor 14.

The riser 11 allows fluid communication between the floating platform 12 and the subsea wellhead 13. The riser 11 includes a subsea tree 15 at its lower end proximate the wellhead 13. The subsea tree 15 can be of any type for controlling pressure in the offshore system 10, for example, vertical or horizontal, production or injection, mono-bore or multi-bore.

A riser connector 16 connects the top of the subsea tree 15 to the riser 11. A subsea connection assembly 17 connects the bottom of the subsea tree 15 to the wellhead 13. The bending capacity of the subsea connection assembly 17 impacts the operational capacity of the system 10.

In some embodiments, bending loads induced by internal pressure end loads and external loads that are over the bending capacity of the subsea connection assembly 17 may induce separation forces in subsea connection assembly 17 leading to leakages and other potential connector failure modes. For example, the riser 11 may sway in the sea, which creates a bending moment between the riser connector 16 and the subsea tree 15.

Although the exemplary offshore system 10 illustrated includes a production riser string (e.g., riser 11), it should be appreciated that the offshore system 10 and the riser 11 may also be designed and configured for drilling and completion operations. Similarly, although the illustrated platform 12 is a SPAR-type platform including mooring lines 18, it should be appreciated that the platform 12 may include other types of floating structures including, but not limited to, floating production storage and offloading (FPSO) systems, semi-submersible platforms, tension leg platforms (TLPs), and others known to those of ordinary skill in the art.

Figure 2:
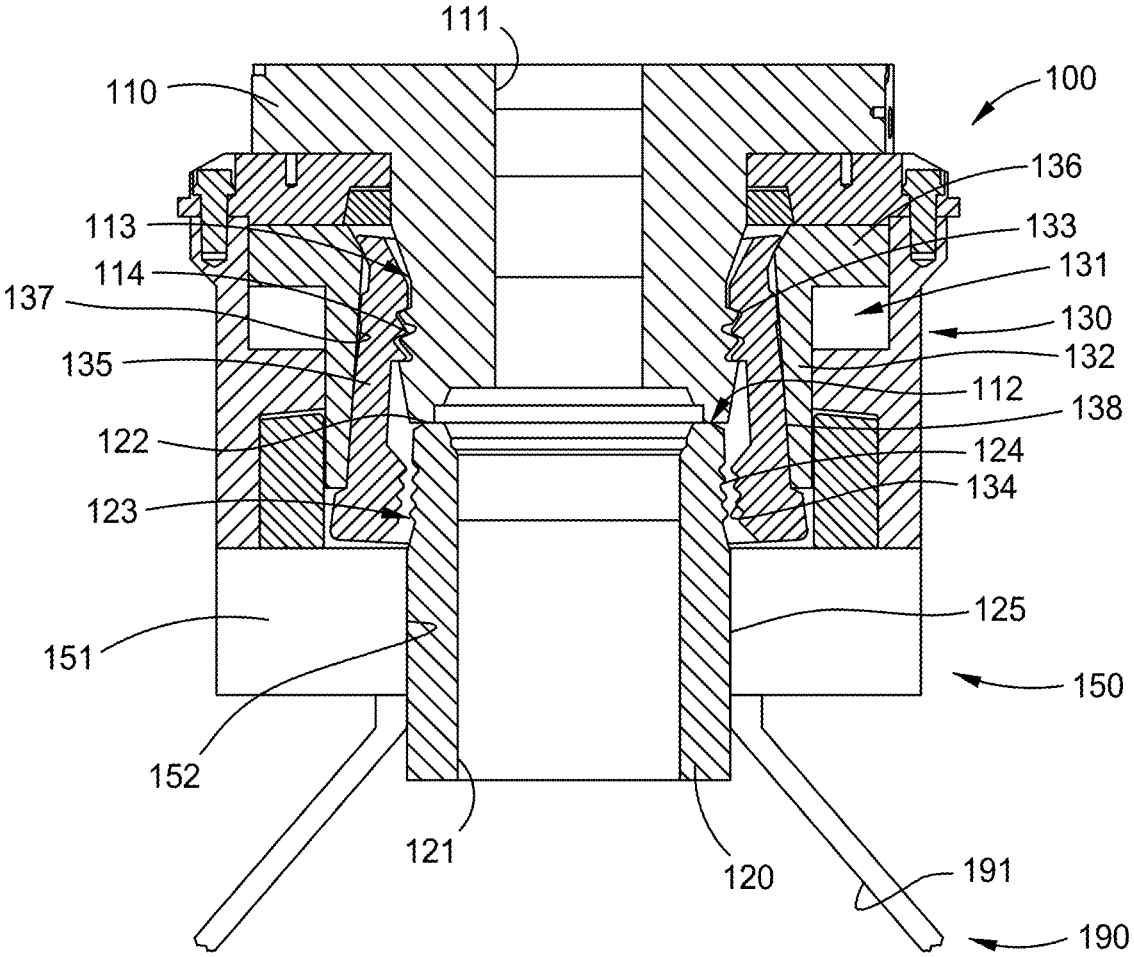
FIG. 2 illustrates a longitudinal cross-section of an exemplary subsea connection assembly, according to one or more embodiments.

FIG. 2 illustrates a longitudinal cross-section of an exemplary subsea connection assembly 100, according to one or more embodiments.

The subsea connection assembly 100 is configured to couple a spool member 110 with a wellhead member 120 to permit fluid communication between the spool member 110 and the wellhead member 120. The spool member 110 can be any subsea production, drilling, or completion component, including, but not limited to, a subsea tree, tree system spool, blowout preventer, riser, or the like. Spool member 110 is generally cylindrical and includes a bore 111 therethrough, a mating surface 112, and an outer surface 113. The outer surface 113 includes an engagement profile 114.

The wellhead 13 includes a wellhead member 120 (e.g., re-entry mandrel). The wellhead member 120 is generally cylindrical and includes a bore 121 therethrough, a mating surface 122, and an outer surface 123. The outer surface 123 includes a first engagement profile 124 and a second engagement profile 125. The first engagement profile 124 is axially spaced from the second engagement profile 125. In some embodiments, the first engagement profile 124 may have a textured surface, such as grooves, while the second engagement profile 125 may be a smooth (e.g., non-textured) surface.

The subsea connection assembly 100 includes a connector 130, a bending moment suppression device 150 coupled to an end of the connector 130, and a funnel 190 coupled to an end of the bending moment suppression device 150. The bending moment suppression device 150 may be removably coupled to the end of the connector 130 by methods, including, but not limited to, a bolted connection. In some embodiments, the bending moment suppression device 150 may be connected to the end of the connector 130 by methods, including, but not limited to, a welded connection. In some embodiments, the bending moment suppression device 150 is integral to, or monolithic with, the connector 130.

The connector 130 includes a locking assembly 131 including an actuator assembly 132, a first engagement portion 133, and a second engagement portion 134. In operation, the locking assembly 131 moves between a disengaged configuration and an engaged configuration. In the disengaged configuration, the first engagement portion 133 of the locking assembly 131 is engaged with the spool engagement profile 114 of the spool member 110. However, the second engagement portion 134 is not engaged with the first engagement profile 124 of the wellhead member 120. In the engaged configuration, the first engagement portion 133 of the locking assembly 131 is engaged with the spool engagement profile 114 of the spool member 110 and the second engagement portion 134 is engaged with the first engagement profile 124 of the wellhead member 120 thus securing the subsea connection assembly 100 to the wellhead member 120.

FIG. 2 shows the spool member 110 mated to the wellhead member 120 prior to moving the connector 130 into the engaged configuration to secure the subsea connection assembly 100 to the wellhead member 120. The wellhead member 120 is guided into contact with the spool member 110 using the funnel 190 as the subsea connection assembly 100 is lowered onto the wellhead member 120. As shown, the mating surface 112 of the spool member 110 mates with and seals against the mating surface 122 of the wellhead member 120 to fluidly couple the bore 111 of the spool member 110 with the bore 121 of the wellhead member 120. In some embodiments, a seal is disposed between the mating surface 112 of the spool member 110 and the mating surface 122 of the wellhead member 120.

The connector 130 is moveable between the engaged and disengaged configurations via the actuator assembly 132. In some embodiments, the actuator assembly 132 is hydraulically actuated by a first hydraulic system.

In the presently illustrated embodiment, the locking assembly 131 is a collet-type locking assembly 131. That is, the locking assembly 131 is a collet with a plurality of collet fingers 135 that include the first engagement portion 133 and the second engagement portion 134. In such embodiments, the first engagement portion 133 of the collet fingers 135 engages the spool engagement profile 114 and second engagement portion 134 engages the first engagement profile 124 of the wellhead member 120 in the engaged position. The collet fingers 135 are moved via a piston 136 of the actuator assembly 132. The piston 136 includes a tapered surface 137. As the piston 136 is moved axially, the tapered surface 137 slides along a corresponding tapered surface 138 of the collet fingers 135 to cause the locking assembly 131 to move between the engaged and disengaged configurations. For example, downhole axial movement of the piston 136 relative to the collet fingers 135, as shown in FIG. 2, will cause collet fingers 135 to engage the wellhead member 120.

However, while presently illustrated embodiment is a collet-type locking assembly 131, the locking assembly 131 may be of another type. In some embodiments, the locking assembly 131 is a dog-type locking assembly 131 wherein a plurality of dogs include the first engagement portion 133 and a second plurality of dogs include the second engagement portion 134. In some embodiments, the locking assembly is a wedge-type locking assembly, with wedges that include the first engagement portion 133 and the second engagement portion 134. In some embodiments, the locking assembly 131 is a slip-type locking assembly 131, wherein slips dogs include the first engagement portion 133 and the second engagement portion 134. In other embodiments, the locking assembly 131 is of another type with a first engagement portion 133 configured to engage with spool engagement profile 114 and a second engagement portion 134 configured to engage with first engagement profile 124 of the wellhead member 120.

The presently illustrated bending moment suppression device 150 includes a housing 151 and one or more engagement members 152. The housing 151 of the bending moment suppression device 150 is coupled to the end of the connector 130 and the engagement members 152 are configured to engage with the second engagement profile 125 of the wellhead member 120 that is axially spaced relative to the first engagement profile 124. The interaction between the at least one engagement member 152 and the second engagement profile 125 of the wellhead member 120 suppresses high bending loads applied to the subsea connection assembly 100 and first engagement profile 124. In other words, the bending moment suppression device 150 resists the bending moment about the first engagement profile 124, which may be applied by loading to the riser 11 and subsea connection assembly 100. The contact between the engagement members 152 and second engagement profile 125 create an additional load path below the locking assembly 131, which increases the bending capacity of the subsea connection assembly 100.

The bending moment suppression device 150 illustrated in FIG. 2 is a representative bending moment suppression device 150. In some embodiments, the bending moment suppression device 150 is a collet-type bending moment suppression device, such as bending moment suppression device 250 of FIGS. 3A-3B. In some embodiments, the bending moment suppression device 150 is a dog-type bending moment suppression device, such as bending moment suppression device 350 of FIGS. 4A-4C. In some embodiments, the bending moment suppression device 150 is a support sleeve-type bending moment suppression device, such as bending moment suppression device 450 of FIG. 5. As such, the bending moment suppression device 150 is operates independently from the connector 130 and, therefore, may be swappable with any of the embodiments described herein.

The funnel 190 is coupled to an end of the bending moment suppression device 150. The funnel 190 has a conical inner bore 191 and is shaped to guide the wellhead member 120 into engagement with the bending moment suppression device 150 and connector 130 during installation of the subsea connection assembly 100. The dimensions of the funnel 190 are such that allow for the wellhead member 120 to be off-center upon deployment of the subsea connection assembly 100 but still enable engagement with the subsea connection assembly 100 by guiding the wellhead member 120 towards center and ultimate engagement with the bending moment suppression device 150 and the connector 130.

Figure 3A:
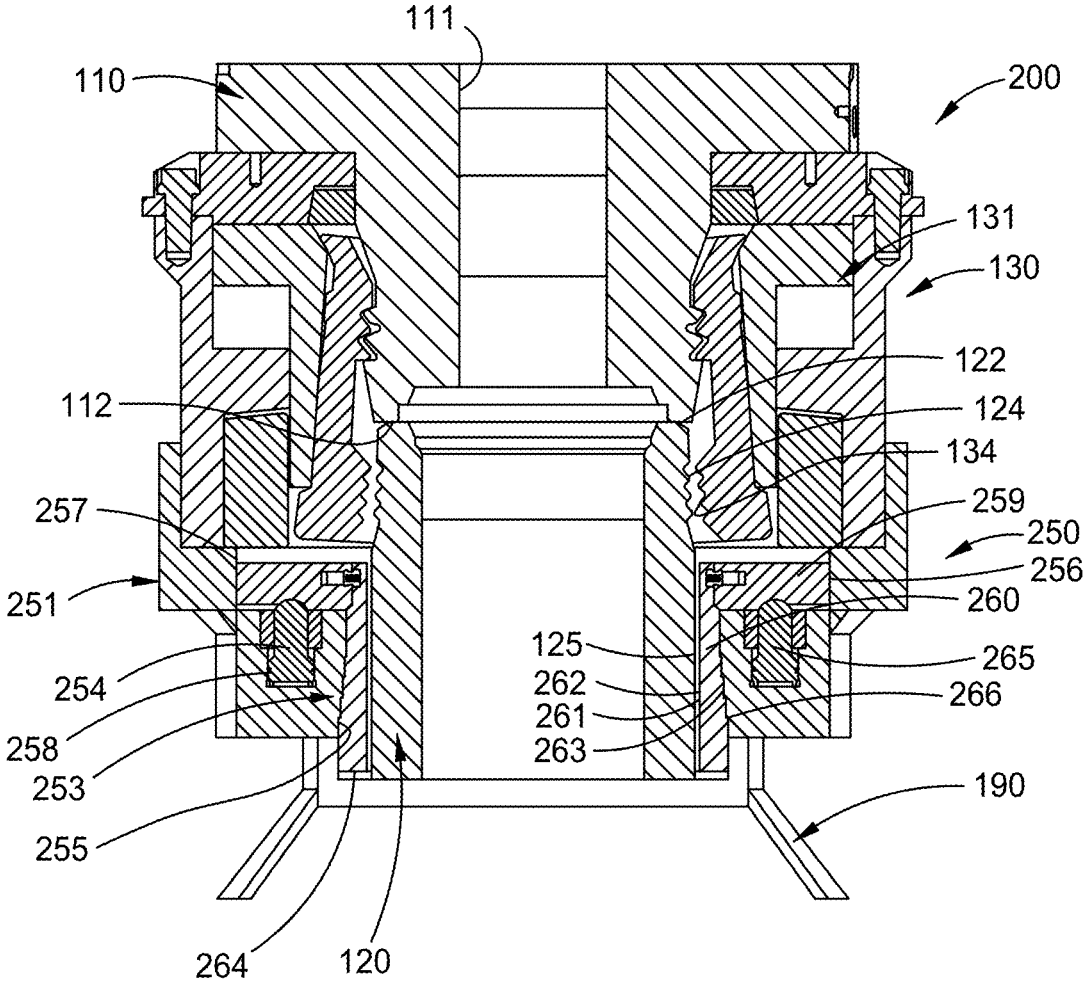
FIG. 3A illustrates a longitudinal cross-sectional view of an exemplary subsea connection assembly including an exemplary bending moment suppression device in a disengaged configuration, according to one or more embodiments.
Figure 3B:
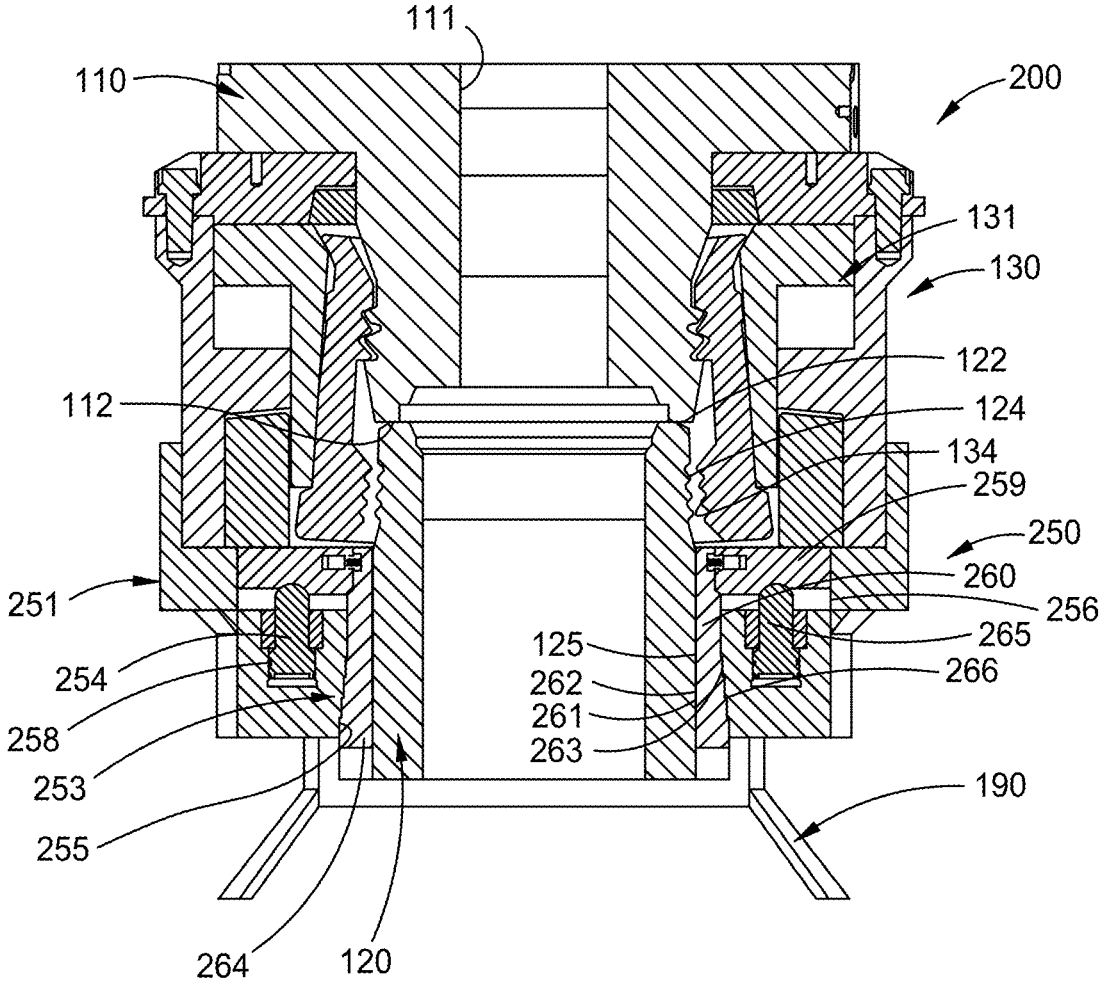
FIG. 3B a longitudinal cross-sectional view of the subsea connection assembly including the bending moment suppression device of FIG. 3A in an engaged configuration, according to one or more embodiments.

FIGS. 3A-3B illustrate a longitudinal cross-sectional view of an exemplary subsea connection assembly 200 including an exemplary bending moment suppression device 250, according to one or more embodiments. Bending moment suppression device 250 includes a housing 251, a collet assembly 253, and an actuator assembly 254 and is configured to selectively engage the wellhead member 120. FIG. 3A illustrates the bending moment suppression device 250 in a disengaged configuration wherein the collet assembly 253 (254) is not engaged with the second engagement profile 125 of the wellhead member 120. FIG. 3B illustrates the bending moment suppression device 250 in an engaged configuration wherein the collet assembly 253 is engaged with the second engagement profile 125 of the wellhead member 120.

The subsea connection assembly 200 includes a connector 130, the bending moment suppression device 250, and a funnel 190. The subsea connection assembly 200 is configured to sealingly engage and fluidly couple the spool member 110 and the wellhead member 120. The bending moment suppression device 250 is configured to selectively engage the wellhead member 120. The connector 130 and the funnel 190 have been described above in FIG. 2. For the sake of brevity, the descriptions of the connector 130 and the funnel 190 will not be repeated.

While exemplary subsea connection assembly 200 is illustrated including a connector 130 with a collet-type locking assembly 131, it should be appreciated by one of ordinary skill in the art that the bending moment suppression device 250 may be assembled to a connector 130 with a different type of locking assembly 131 including, but not limited to, those previously disclosed.

The housing 251 includes an inner surface 256. A portion of an inner surface 256 of the housing 251 includes a tapered profile 266. The inner surface 256 also defines a bore 255 that the collet assembly 253 and wellhead member 120 are at least partially disposed within when the subsea connection assembly 200 is engaged with the wellhead member 120. The inner surface 256 of the housing 251 further includes a recessed top portion 257 and one or more actuator openings 258 circumscribing the bore 255 of the housing 251.

The collet assembly 253 includes a collet actuation ring 259 and a collet 260. The collet actuation ring 259 is disposed in the recessed top portion 257 of the housing 251 and is coupled to the top of the collet 260 such that when the collet actuation ring 259 is moved (e.g., up or down) the collet 260 is similarly moved. The collet actuation ring 259 is coupled to the top of the collet 260 by methods, including, but not limited to a bolted connection. The collet 260 is disposed in the bore 255 of the housing 251 and includes an inner bore 261 defined by an inner surface 262 of the collet 260. The collet 260 has a tapered outer surface 263 that is slidably engaged with the tapered portion 266 of the inner surface 256 of the housing 251. The collet 260 further includes collet fingers 264 defining at least a bottom portion of the collet 260. The inner side of the collet fingers 264 each include a portion of the inner surface 262 and the outer side of the collet fingers 264 each include a portion of the tapered outer surface 263. The collet fingers 264 are biased radially outward (e.g., away from the inner bore 261) such that, in the free-state, the inner bore 261 of the collet 260 is generally conical with the inner bore 261 having a larger diameter at its lower portion than at its upper portion.

The actuator assembly 254 includes one or more actuators 265 disposed in the one or more actuator openings 258 of the housing 251. The one or more actuators 265 engage with the collet actuation ring 259 and are actuated to move the collet assembly 253 with respect to the housing 251 (e.g., upwards or downwards) within the bore 255 of the housing 251 along the tapered portion 266 of the inner surface 256 of the housing 251.

In some embodiments, the housing 251 includes one annular actuator opening 258 about the circumference of the bore 255 of the housing 251 and the actuator assembly 254 includes one annular actuator 265 disposed in the one annular actuator opening 258, wherein the annular actuator 265 circumscribes the bore 255 of the housing 251. In some embodiments, the actuator assembly 254 includes a plurality of actuators 265 disposed in a plurality of actuator openings 258 of the housing circumscribing the bore 255.

The actuator assembly 254 may be independent from the connector 130 actuator assembly 132 such that the actuator assembly 132 of the connector 130 may be independently actuated from the actuator assembly 254 of the bending moment suppression device 250 and vice versa. In one or more embodiments, the actuator assembly 254 is hydraulically actuated.

As previously indicated, the bending moment suppression device 250 is movable between the disengaged configuration shown in FIG. 3A, and the engaged configuration shown in FIG. 3B. In the disengaged configuration, the collet 260 of the bending moment suppression device 250 is disengaged from the second engagement profile 125 of the wellhead member 120. That is, the inner surface 262 of the collet 260 is not contacting the outer surface 123 of the wellhead member 120. In the engaged configuration, the inner surface 262 of the collet 260 is engaged with the second engagement profile 125 of the wellhead member 120.

The bending moment suppression device 250 may be moved into the engaged configuration by actuating the actuator assembly 254, as shown in FIG. 3B. Actuating the actuator assembly 254 extends the one or more actuators 265 upward (e.g., in an upward axial direction) relative to the housing 251 of the bending moment suppression device 250. The upward motion moves the collet actuation ring 259 and the collet 260 upward with respect to the housing 251. As the collet 260 is moved upwards, the tapered outer surface 263 of the collet 260 slides along the tapered portion 266 of the inner surface 256 of the housing 251. As the tapered outer surface 263 of the collet 260 slides along the tapered portion 266 of the inner surface 256 of the housing 251, the collet fingers 264 are forced inwards (e.g., towards the inner bore 261 of the collet 260) and into engagement with the second engagement profile 125 of the wellhead member 120. Thus, in the engaged configuration of the bending moment suppression device 250, the inner surface 262 of the collet 260 is engaged with the second engagement profile 125 of the wellhead member 120.

In the engaged configuration, the interaction between the inner surface 262 of the collet 260 and the second engagement profile 125 of the wellhead member 120 suppresses high bending loads applied to the subsea connection assembly 200 and first engagement profile 124. In other words, the bending moment suppression device 250 resists the bending moment about the first engagement profile 124, which may be applied by loading to the riser 11 and subsea connection assembly 200. The contact between the inner surface 262 of the collet 260 and second engagement profile 125 create an additional load path below the locking assembly 131, which increases the bending capacity of the subsea connection assembly 200.

In some embodiments, the bending moment suppression device 250 may be moved to the disengaged configuration by retracting the one or more actuators 265. In some embodiments, the bending moment suppression device 250 may be moved to the disengaged configuration by lifting the subsea connection assembly 200.

For example, the one or more actuators 265 may be retracted within the openings 258 of the housing 251 to move the collet 260 downward to move the bending moment suppression device 250 into the disengaged configuration. As the collet 260 moves downward, the tapered outer surface 263 of the collet 260 slides along the tapered portion 266 of the inner surface 256 of the housing 251. As the tapered outer surface 263 of the collet 260 slides along the tapered portion 266 of the inner surface 256 of the housing 251, the bias of the collet fingers 264 forces the collet fingers 264 and the inner surface 262 of the collet 260 away (e.g., outwards) from the inner bore 261 of the collet 260 and the wellhead member 120.

In another example, moving the bending moment suppression device 250 into the disengaged configuration may include moving the one to more actuators 265 so that the one or more actuators 265 no longer exert an upward force on the collet 260. The locking assembly 131 of the connector 130 is then moved into the disengaged configuration thus disengaging the second engagement portion 134 of the locking assembly 131 from the first engagement profile 124 of the wellhead member 120. With the wellhead member 120 disengaged from the subsea connection assembly 200, the subsea connection assembly 200 is lifted. As the subsea connection assembly 200 is lifted, the friction between the inner surface 262 of the collet 260 and the second engagement profile 125 of the wellhead member 120 holds the collet 260 static with respect to the wellhead member 120. As the subsea connection assembly 200 is lifted further, the tapered portion 266 of the inner surface 256 of the housing 251 is moved along the tapered outer surface 263 of the collet 260 and the bias of the collet fingers 264 forces the collet fingers 264 and the inner surface 262 of the collet 260 outwards (e.g., away from the inner bore 261 of the collet 260 and the wellhead member 120) to disengage the collet 260 from the wellhead member 120.

During an exemplary installation operation, the subsea connection assembly 200 and the spool member 110 are guided onto the wellhead member 120 by the funnel 190 so that the mating surface 112 of the spool member 110 mates with the mating surface 122 of the wellhead member 120 while the locking assembly 131 and the bending moment suppression device 250 are each in the disengaged configuration. After the spool member 110 and the wellhead member 120 are mated, the locking assembly 131 and the bending moment suppression device 250 are each moved into the engaged configuration.

In some embodiments, the locking assembly 131 and the bending moment suppression device 250 are simultaneously moved into the engaged configuration. In some embodiments, the bending moment suppression device 250 is moved into the engaged configuration before the locking assembly 131 moved into the engaged configuration. Alternatively, in some embodiments, the locking assembly 131 of the connector 130 is moved into the engaged configuration before the bending moment suppression device 250 is moved into the engaged configuration.

During an exemplary disconnection operation, the locking assembly 131 and the bending moment suppression device 250 are each moved into the disengaged configuration. In some embodiments, the locking assembly 131 and the bending moment suppression device 250 are simultaneously moved into the disengaged configuration. In some embodiments, the bending moment suppression device 250 is moved into the disengaged configuration before the locking assembly 131 is moved into the disengaged configuration. Alternatively, in some embodiments the locking assembly 131 is moved into the disengaged configuration before the bending moment suppression device 250 is moved into the disengaged configuration.

Figure 4A:
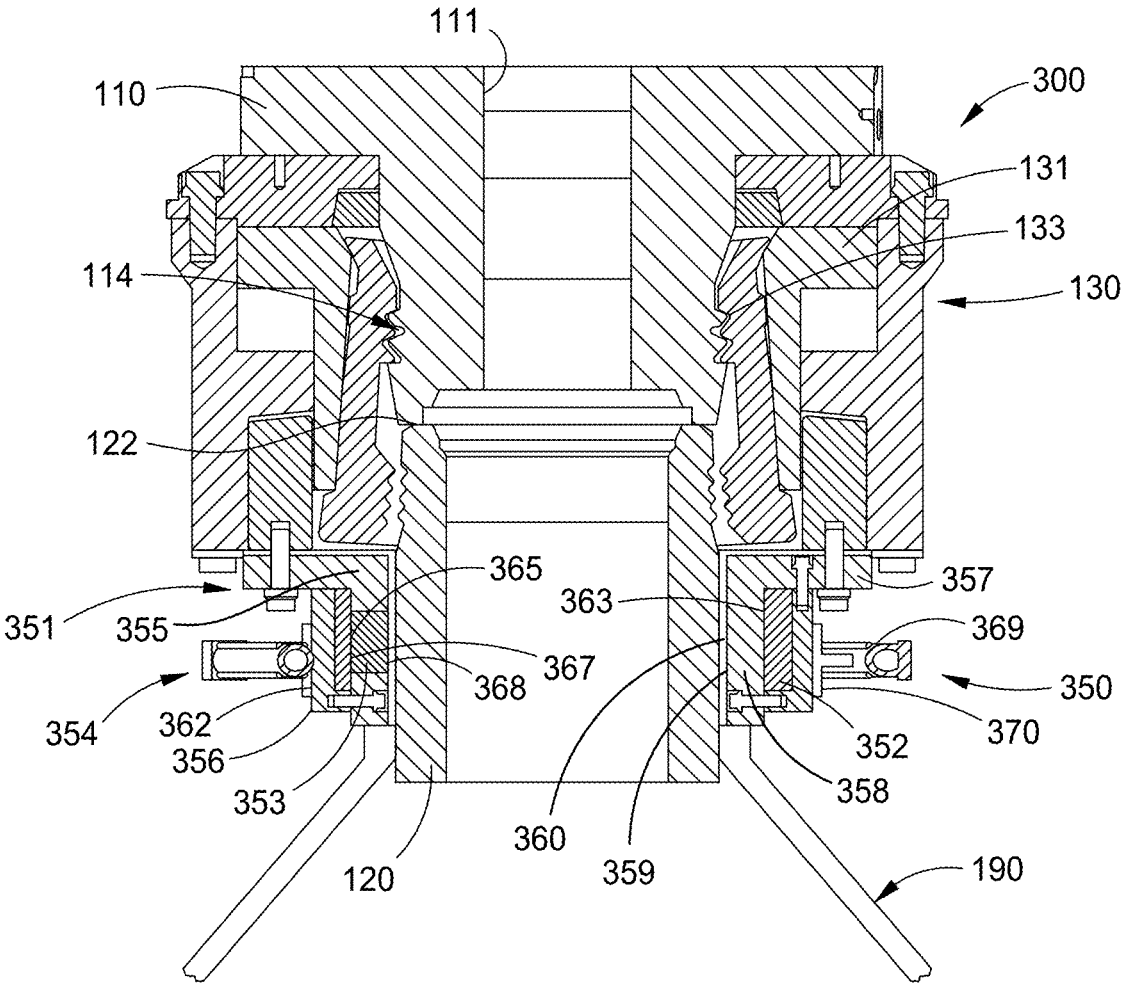
FIG. 4A illustrates a longitudinal cross-sectional view of an exemplary subsea connection assembly including another exemplary bending moment suppression device in a disengaged configuration, according to one or more embodiments.
Figure 4B:
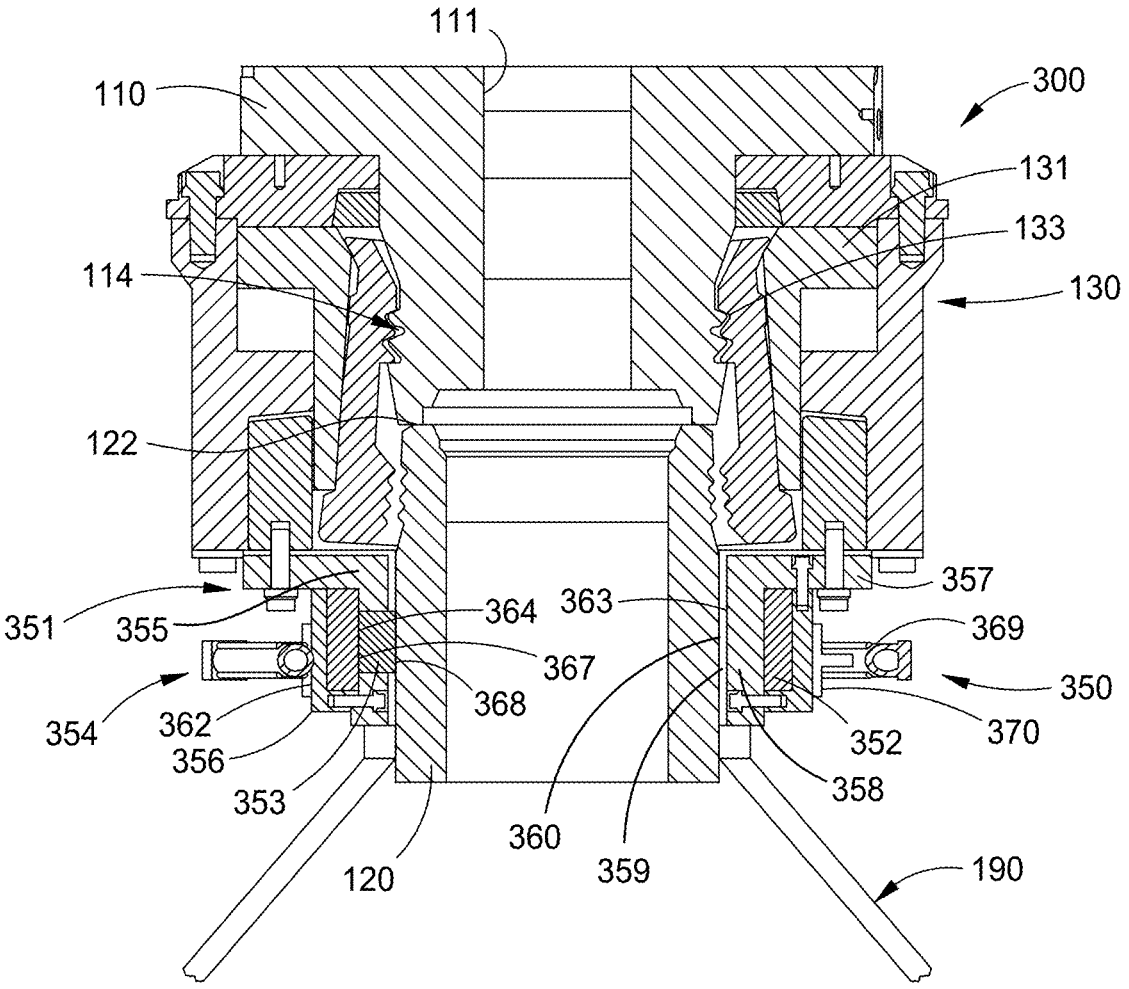
FIG. 4B illustrates a perspective view of the bending moment suppression device of FIG. 4A in an engaged configuration, according to one or more embodiments.
Figure 4C:
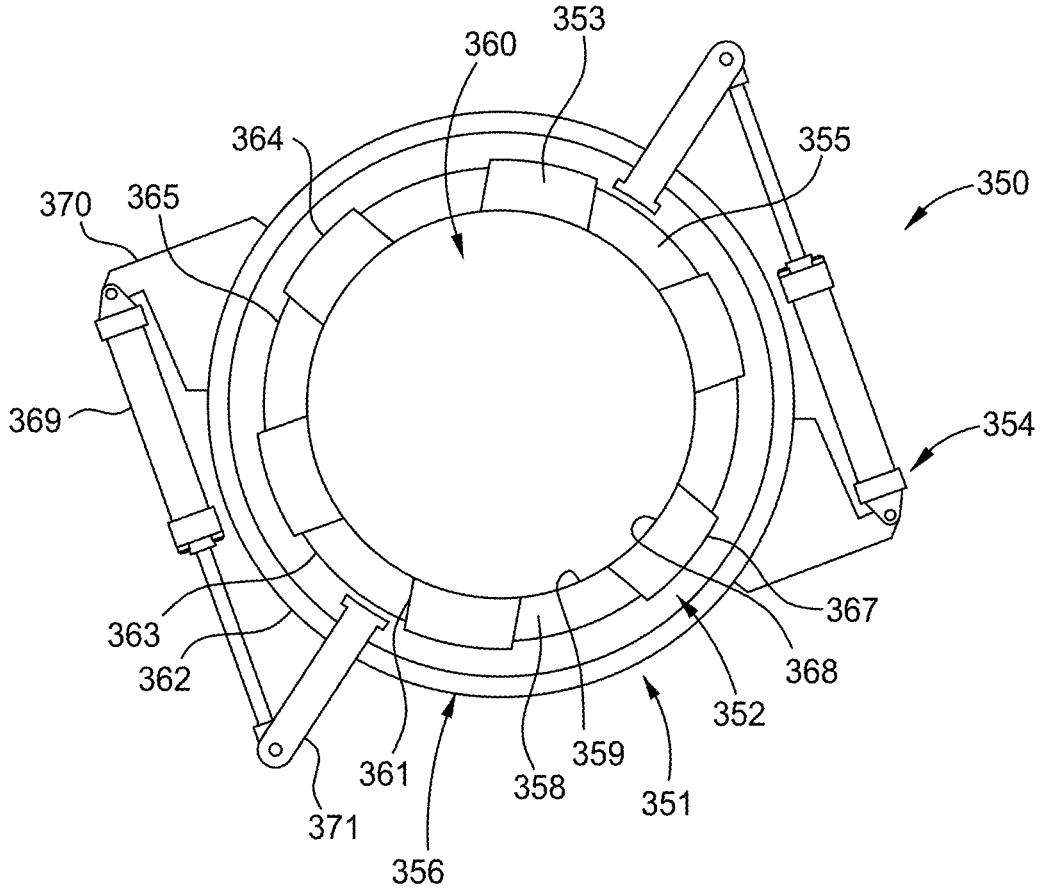
FIG. 4C illustrates a top cross-sectional view of the bending moment suppression device of FIG. 4A, according to one or more embodiments.

FIGS. 4A-4C illustrate an exemplary subsea connection assembly 300 including another exemplary bending moment suppression device 350, according to one or more embodiments. The bending moment suppression device 350 includes a housing 351, an actuation ring 352, a plurality of dogs 353, and an actuator assembly 354 and is configured to selectively engage the wellhead member 120. FIG. 4A illustrates a longitudinal cross-sectional view of the bending moment suppression device 350 in a disengaged configuration wherein the dogs 353 are in a retracted position and, thus, not engaged with the second engagement profile 125 of the wellhead member 120. FIG. 4B illustrates a longitudinal cross-sectional view of the bending moment suppression device 350 in an engaged configuration wherein the dogs 353 are in an extended position and, thus, are engaged with the second engagement profile 125 of the wellhead member 120. FIG. 4C illustrates a top cross-sectional view of the bending moment suppression device 350.

The subsea connection assembly 300 includes the connector 130, the bending moment suppression device 350, and the funnel 190. The subsea connection assembly 300 is configured to sealingly engage and fluidly couple the spool member 110 and the wellhead member 120. The connector 130 and the funnel 190 have been described above in the description of connector 130 and funnel 190 in FIG. 2. For the sake of brevity, the descriptions of the connector 130 and the funnel 190 will not be repeated.

While exemplary subsea connection assembly 300 is illustrated including a connector 130 with a collet-type locking assembly 131, it should be appreciated by one of ordinary skill in the art that the bending moment suppression device 350 may be assembled to a connector 130 with a different type of locking assembly 131 including, but not limited to, those previously disclosed.

The housing 351 of the bending moment suppression device 350 includes a first body 355 coupled to a second body 356. The first body 355 includes a top flange 357 and a sleeve 358. The top flange 357 is coupled to an end of the connector 130 by, for example, a bolted connection. The sleeve 358 has an inner surface 359 defining a bore 360. The sleeve 358 also includes a plurality of windows 361 disposed through the sleeve 358 and opening to the bore 360. The windows 361 are arranged around the bore 360. Each dog 353 is disposed and moveable within a corresponding window 361. Although the illustrated embodiment includes six windows 361 and six dogs 353, there may be two, three, four, five, six, seven, or more windows 361 and dogs 353 in some embodiments. The second body 356 surrounds and contains the actuation ring 352, the plurality of dogs 353, and the sleeve 358 of the first body 355 and defines the radial outer surface 362 of the bending moment suppression device 350.

The actuation ring 352 is disposed between the sleeve 358 and the second body 356. The actuation ring 352 is rotatable relative to the sleeve 358 and the second body 356. The inner surface 363 of the actuation ring 352 defines an actuation profile that facilitates extending the dogs 353 as the actuation ring 352 is rotated relative to the sleeve 358 in a first direction and facilitates retracting the dogs 353 as the actuation ring rotates relative to the sleeve 358 in a second direction. In some embodiments, the actuation profile includes a plurality of cam profiles (e.g., lobes) 364 to cause the dogs 353 to move to the extended position as the actuation ring 352 rotates in a first direction (e.g., clockwise) and a plurality of cam profiles (e.g., lobed valleys) 365 that allow the dogs 353 to retreat to the retracted position as the actuation ring 352 rotates in a second direction (e.g., counter-clockwise). The number of lobes 364 and lobed valleys 365 correspond to the number of dogs 353.

Each dog 353 includes an outer surface 367 and an inner surface 368 and is aligned with the windows 361. The outer surface 367 of each dog 353 is slidingly engaged with the actuation profile (e.g., inner surface 363) of the actuation ring 352. Thus, when the actuation ring 352 is rotated within the second body 356 of the housing 351, the outer surface 367 of each dog 353 slides along the inner surface 363 of the actuation ring 352. For example, rotation of the actuation ring 352 in the first direction causes the dog 353 that is initially disposed in a lobed valley 365, and thus in the retracted position, to slide along a lobe 364 to move the dog 353 to the extended position. The inner surface 368 of each dogs 353 is configured to engage with the second engagement profile 125 of the wellhead member 120 when the dog 353 is in the extended position.

Therefore, as each of the plurality of dogs 353 slides up each of the lobes 364, each of the plurality of the dogs 353 are guided through each of the windows 361 inward and towards the bore 360 of the inner sleeve 358 to engage with the second engagement profile 125 of the wellhead member 120. The actuation ring 352 is maintained in a position to keep the dogs 353 wedged between the lobe 364 and the second engagement profile 125 (e.g., wedged into a gripping engagement) so long as engagement is desired.

The actuation ring 352 can be rotated in the second direction to release the dogs 353 from engagement with the second engagement profile 125. The dogs 353 are no longer wedged between the actuation ring 352 and the second engagement profile 125. In some embodiments, one or more of the dogs 353 slides along the lobe 364 into the corresponding of the lobed valleys 365 as the dogs 353 move to the retracted position. In some embodiments, a biasing member coupled to the dogs 353 assists in the retraction of the dogs 353 as the actuation ring.

The actuator assembly 354 includes one or more actuators 369 that cause the actuation ring 352 to rotate within the housing 351. In some embodiments, the actuator assembly 354 includes one or more actuator mounts 370 corresponding to each of the one or more actuators 369 and one or more actuator arms 371 corresponding to each of the one or more actuators 369. The one or more actuators 369 are coupled to the outer surface 362 of the second body 356 by the one or more actuator mounts 370. The one or more actuators 369 are coupled to the actuation ring 352 by the one or more actuator arms 371. The one or more actuators 369 are configured to rotate the actuator ring 352 with respect to the housing 351 by extending or retracting thereby moving each of the actuator arms 371.

The actuator assembly 354 may be independent from the connector 130 actuator assembly 132 such that the actuator assembly 132 of the connector 130 may be independently actuated from the actuator assembly 354 of the bending moment suppression device 350 and vice versa. In one or more embodiments, the actuator assembly 354 is hydraulically actuated. For example, the actuator assembly 354 of the bending moment suppression device 350 and actuator assembly 132 of the connector 130 may be operated by independent hydraulic circuits.

As previously indicated, the bending moment suppression device 350 is moveable between the disengaged configuration, as shown in FIG. 4A, and the engaged configuration, as shown in FIG. 4B. In the disengaged configuration, actuator ring 352 is rotated to move the dogs 353 in the retracted position disengaged from the wellhead member 120. In the engaged configuration, the actuator ring 352 is rotated to move the dogs 353 are in an extended position and are engaged with the second engagement profile 125 of the wellhead member 120.

In the engaged configuration, the bending moment suppression device 350 reduces bending moments exerted on the connection between the wellhead member 120 and the spool member 110 by providing at least a second axial point of contact between the wellhead member 120 and the subsea connection assembly 300 thus reducing the risk of leakage through said connection.

During an exemplary installation operation, the subsea connection assembly 300 and the spool member 110 are guided onto the wellhead member 120 so that the mating surface 112 of the spool member 110 mates with the mating surface 122 of the wellhead member 120 while the locking assembly 131 and the bending moment suppression device 350 are each in the disengaged configuration. After the spool member 110 and the wellhead member 120 are mated, the locking assembly 131 and the bending moment suppression device 350 are each moved into the engaged configuration.

In some embodiments, the locking assembly 131 and the bending moment suppression device 350 are simultaneously moved into the engaged configuration. In some embodiments, the bending moment suppression device 350 is moved into the engaged configuration before the locking assembly 131 moved into the engaged configuration. Alternatively, in some embodiments, the locking assembly 131 is moved into the engaged configuration before the bending moment suppression device 350 is moved into the engaged configuration.

During an exemplary disconnection operation, the locking assembly 131 and the bending moment suppression device 350 are each moved into the disengaged configuration. In some embodiments, the locking assembly 131 and the bending moment suppression device 350 are simultaneously moved into the disengaged configuration. In some embodiments, the bending moment suppression device 350 is moved into the disengaged configuration before the locking assembly 131 is moved into the disengaged configuration. Alternatively, in some embodiments the locking assembly 131 is moved into the disengaged configuration before the bending moment suppression device 350 is moved into the disengaged configuration.

Figure 5:
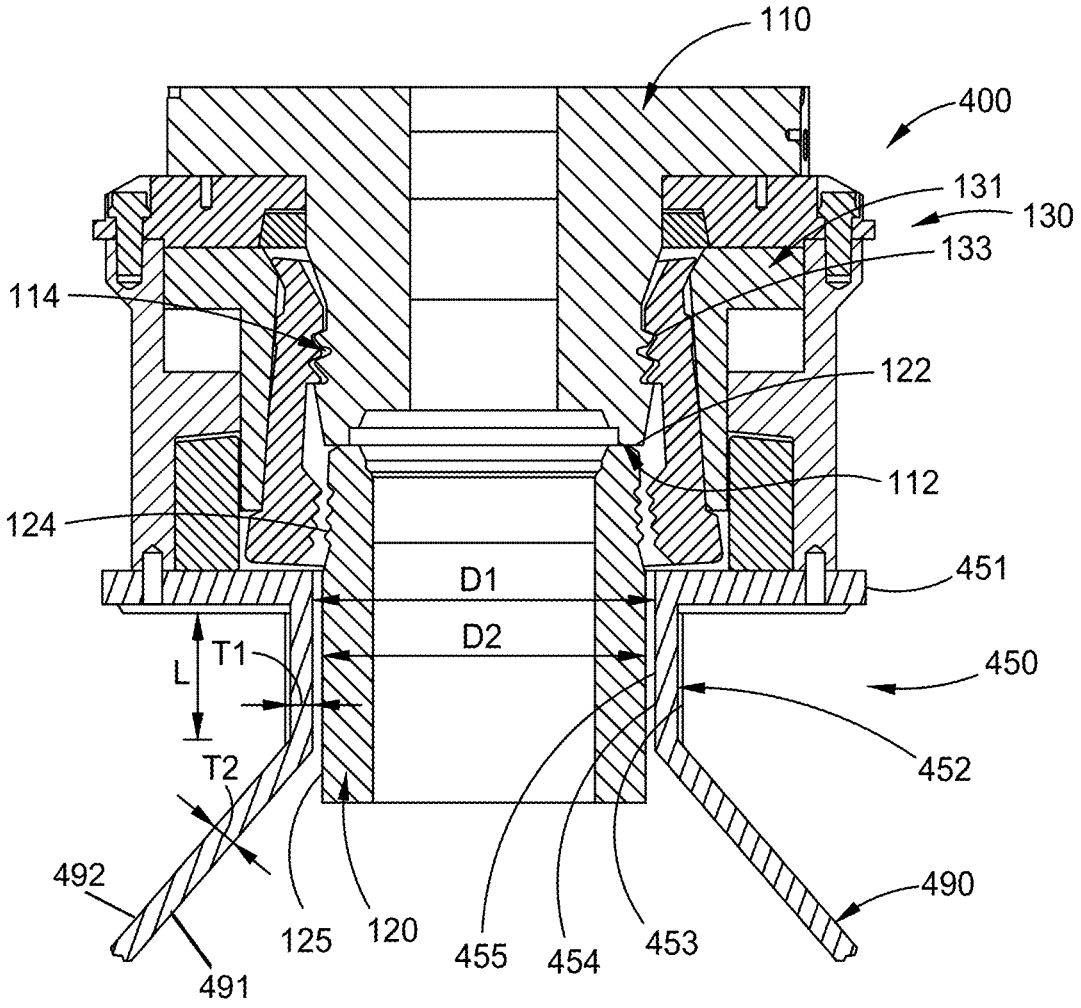
FIG. 5 illustrates a longitudinal cross-sectional view of an exemplary subsea connection assembly including another exemplary bending moment suppression device, according to one or more embodiments.

FIG. 5 illustrates a longitudinal cross-sectional view of an exemplary subsea connection assembly 400 including another exemplary bending moment suppression device 450, according to one or more embodiments. The bending moment suppression device 450 includes a flange 451 and a support sleeve 452 and is configured to support the wellhead member 120 at its second engagement profile 125.

The subsea connection assembly 400 includes a connector 130 and the bending moment suppression device 450. The subsea connection assembly 400 is configured to sealingly engage and fluidly couple the spool member 110 and the wellhead member 120. The connector 130 has been described above in the description of connector 130 for FIG. 2. For the sake of brevity, the description of connector 130 will not be repeated.

While exemplary subsea connection assembly 400 is illustrated including a connector 130 with a collet-type locking assembly 131, it should be appreciated by one of ordinary skill in the art that the bending moment suppression device 450 may be assembled a connector 130 with a different type of locking assembly 131 including, but not limited to those previously disclosed.

The top of flange 451 is coupled to an end of the connector 130 by, for example, a bolted connection. The support sleeve 452 is coupled to the bottom of flange 451. In some embodiments, the support sleeve 452 is coupled to the bottom of flange 451 by fasteners. In some embodiments, the support sleeve 452 is welded to the bottom of flange 451. Still, in other embodiments, the support sleeve 452 is integral to, or monolithic with, the flange 451. The opposite end of the support sleeve 452 is coupled to the funnel 490. The support sleeve 452 may be coupled to the funnel 490 by similar methods to those used in coupling the support sleeve 452 to the top flange 451.

The support sleeve 452 includes an outer surface 453 and an inner surface 454 defining a bore 455 with a diameter "D1" larger than a diameter "D2" of the wellhead member 120. The support sleeve 452 includes a wall thickness "T1" between inner surface 454 and outer surface 453. The support sleeve 452 similarly includes a length "L" extending from the top flange 451 to the funnel 490.

The funnel 490 includes an inner surface 491 and an outer surface 492. The funnel 490 has a wall thickness "T2" separating the inner surface 491 and the outer surface 492.

When the subsea connection assembly 100 is installed onto the wellhead member 120 and the spool member 110, the wellhead member 120 is disposed in the bore 455 of the support sleeve 452. The difference between D1 and D2 is sized to allow the wellhead member 120 to be installed through the bottom of the funnel 490, but also is minimized to facilitate the wellhead member 120 engaging with the inner surface 454 of the support sleeve 452 to suppress a bending moment. In other words, the diameter of the bore 455 is machined with a high tolerance to facilitate the support sleeve 452 bearing the load of the engagement between the wellhead member 120 and inner surface 454. In some embodiments the difference between D1 and D2 is about 0.200" to about 0.020." The prevention of bending about the first engagement profile acts to suppress internal pressure end loads and external tension that induce high bending loads and separation forces in wellhead connections that lead to potential leaks between the wellhead member 120 and the spool member 110. Similarly, Wall thicknesses "T1" is sized to bear the load between the wellhead member 120 and the support sleeve 452 to prevent and/or limit the deformation of the support sleeve 452. In other words, the support sleeve 452 is sufficiently thick such that the support sleeve 452 can suppress the bending moment rather than failing. Thus, the support sleeve 452 provides at least a second axial point of contact between the wellhead member 120 and the subsea connection assembly 400 at or near the second engagement profile 125 of the wellhead member. Similarly, length "L" is sized to counteract deformation and provide a second axial point of contact between the wellhead member 120 and the subsea connection assembly 400. Further, the bending moment suppression device 450 and funnel 490 may be made of a rigid material to counteract deformation and a second axial point of contact between the wellhead member 120 and the subsea connection assembly 400. In some embodiments, the bending moment suppression device 450 and the funnel 490 are constructed of structural steel. In some embodiments, the wall thicknesses T1 and T2 and length L are sized to be resilient against repeated deformation and applied bending moments. In some embodiments, T1 and T2 may be in a range of about 1.0" to about 2.0.".

During an exemplary installation operation, the subsea connection assembly 400 and the spool member 110 are be guided onto the wellhead member 120 so that the mating surface 112 of the spool member 110 mates with the mating surface 122 of the wellhead member 120 by the funnel 490 while the connector 130 is in the disengaged configuration. After the spool member 110 and the wellhead member 120 are mated, the connector 130 is moved into the engaged configuration thus sealingly engaging and fluidly coupling the wellhead member 120 and the spool member 110.

EXAMPLE ASPECTS

Aspect 1: A subsea connector assembly for coupling a spool member to a wellhead member, comprising a connector and a bending moment suppression device coupled to the connector. The connector includes a lock assembly configured to engage a first portion of a wellhead member. The bending moment suppression device is configured to engage a second portion of the wellhead member, wherein the second portion is spaced axially from the first portion. The bending moment suppression device, includes a housing, a collet, and a first actuator assembly. The housing includes an inner surface defining a bore, the inner surface having a collet actuation profile. The collet is disposed in the bore of the housing, the collet including a plurality of collet fingers engaged with the collet actuation profile, wherein the collet is axially moveable relative to the housing within the bore to move the collet fingers along the collet actuation profile moving the plurality of collet fingers between a disengaged position and an engaged position, and wherein the collet fingers are engaged with the second portion of the wellhead member when in the engaged position. The first actuator assembly is configured to move the collet axially relative to the housing.

Aspect 2: The subsea connector assembly of Aspect 1, wherein the bending moment suppression device is coupled to and extends from an end of the connector.

Aspect 3: The subsea connector assembly of any combination of Aspects 1-2, wherein the connector further includes a second actuator assembly configured to actuate the lock assembly to engage the lock assembly with the first portion of the wellhead member.

Aspect 4: The subsea connector assembly of Aspect 3, wherein the first actuator assembly and second actuator assembly each include at least one hydraulic actuator, and wherein the first hydraulic actuator is fluidly independent from the second actuator assembly.

Aspect 5: The subsea connector assembly any combination of Aspects 1-4, wherein the first actuator assembly includes one or more actuators disposed in the housing and connected to the collet.

Aspect 6: The subsea connector assembly of any combination of Aspects 1-5, wherein the collet actuation profile is an axially extending taper.

Aspect 7: The subsea connector assembly of any combination of Aspects 1-6, wherein the bending moment suppression device further comprises a collet actuator ring coupled to the collet, wherein the first actuator assembly is engaged with the collet actuator ring, and the first actuator assembly is configured to move the collet actuator ring axially to move the collet relative to the housing.

Aspect 8: The subsea connector assembly of any of combination of Aspects 1-7, wherein the collet is a first collet, and the lock assembly includes a second collet engageable with the first portion of the wellhead member Aspect 9: The subsea connector assembly of any combination of Aspects 1-8, wherein in the engaged position, the collet fingers are radially retracted.

Aspect 10: The subsea connector assembly of any combination of Aspects 1-9, wherein in the disengaged position, the collet fingers are radially extended.

Aspect 11: A subsea connector assembly for coupling a spool member to a wellhead member, comprising a connector and a bending moment suppression device. The connector includes a lock assembly configured to engage a first portion of a wellhead member. The bending moment suppression device is coupled to the connector configured to engage a second portion of the wellhead member, wherein the second portion is spaced axially from the first portion. The bending moment suppression device includes an actuation ring, a plurality of dogs, and a first actuator assembly. The actuation ring has a profile. The plurality of dogs are movable along the profile between a disengaged position and an engaged position. The first actuator assembly includes at least one actuator configured to rotate the actuation ring relative to the connector to move the plurality of dogs along the profile between the disengaged position and the engaged position, wherein in the engaged position, the plurality of dogs are engaged with the second portion of the wellhead member.

Aspect 12: The subsea connector assembly of Aspect 11, wherein the bending moment suppression device is coupled to and extends from an end of the connector.

Aspect 13: The subsea connector assembly of any combination of Aspects 11-12, wherein the connector further includes a second actuator assembly configured to engage the lock assembly with the first portion of the wellhead member.

Aspect 14: The subsea connector assembly of Aspect 13, wherein the first actuator assembly and second actuator assembly each include at least one hydraulic actuator, and wherein the first actuator assembly is fluidly isolated from the second actuator assembly.

Aspect 15: A method for coupling a spool member to a wellhead member, comprising: engaging a first portion of a wellhead member with a lock assembly of a connector; and engaging a second portion of the wellhead member that is spaced axially from the first portion with a plurality of collet fingers of a collet of a bending moment suppression device coupled to an end of the connector, wherein engaging the second portion includes moving the collet of the bending moment suppression device axially with respect to a housing of the bending moment suppression device to move the plurality of collet fingers of the collet into engagement with the second portion of the wellhead member.

Aspect 16: The method of Aspect 15, wherein moving the collet of the bending moment suppression device comprises axially moving the collet with respect to the housing of the bending moment suppression device includes actuating a first actuator assembly to move the collet.

Aspect 17: The method of Aspect 16, wherein engaging the first portion of the wellhead member with the lock assembly includes actuating a second actuator assembly to engage the first portion of the wellhead member with the locking assembly.

Aspect 18: The method of Aspect 17, wherein the first actuator assembly and second actuator assembly are hydraulically operated and the first actuator assembly is fluidly independent from the second actuator assembly.

Aspect 19: The method of any combination of Aspects 15-18 further comprising disengaging the plurality of collet fingers from the second portion of the wellhead member.

Aspect 20: The method of Aspect 19, wherein disengaging the plurality of collet fingers from the second portion of the wellhead member includes lifting the housing to move the housing axially with respect to the collet along a tapered profile.

Any one or more components of subsea connection assemblies 200, 300, and 400 may be integrally formed together, directly coupled together, and/or indirectly coupled together and are not limited to the specific arrangement of components illustrated in FIGS. 1-5. Any one or more of the embodiments of the subsea connection assemblies 200, 300, and 400 may be combined in whole or part with any one or more of the embodiments of the subsea connection assemblies 200, 300, and 400.

While the present disclosure has been described with respect to a number of embodiments and examples, those skilled in the art, having benefit of this disclosure, will appreciate that other embodiments may be devised that do not depart from the scope and spirit of the present disclosure.

It will be appreciated by those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within the scope of the disclosure. It is therefore intended that the following appended claims may include all such modifications, permutations, enhancements, equivalents, and improvements. The disclosure also contemplates that one or more aspects of the embodiments described herein may be substituted in for one or more of the other aspects described. The scope of the disclosure is determined by the claims that follow.

What is claimed is:

1. A subsea connector assembly for coupling a spool member to a wellhead member, comprising:

a connector including a lock assembly configured to engage a first portion of a wellhead member; and a bending moment suppression device coupled to the connector configured to engage a second portion of the wellhead member, wherein the second portion is spaced axially from the first portion, the bending moment suppression device including:

a housing including an inner surface defining a bore, the inner surface having a collet actuation profile;

a collet disposed in the bore of the housing, the collet including a plurality of collet fingers engaged with the collet actuation profile, wherein the collet is axially moveable relative to the housing within the bore to move the collet fingers along the collet actuation profile moving the plurality of collet fingers between a disengaged position and an engaged position, and wherein the collet fingers are engaged with the second portion of the wellhead member when in the engaged position;

a first actuator assembly configured to move the collet axially relative to the housing; and a collet actuator ring coupled to the collet, wherein the first actuator assembly is engaged with the collet actuator ring, and the first actuator assembly is configured to move the collet actuator ring axially moving the collet relative to the housing.

2. The subsea connector assembly of claim 1, wherein the bending moment suppression device is coupled to and extends from an end of the connector.

3. The subsea connector assembly of claim 1, wherein the connector further includes a second actuator assembly configured to actuate the lock assembly to engage the lock assembly with the first portion of the wellhead member.

4. The subsea connector assembly of claim 3, wherein the first actuator assembly and the second actuator assembly each include at least one hydraulic actuator, and wherein the at least one hydraulic actuator of the first actuator assembly is fluidly independent from the second actuator assembly.

5. The subsea connector assembly of claim 1, wherein the first actuator assembly includes one or more actuators disposed in the housing and connected to the collet.

6. The subsea connector assembly of claim 1, wherein the collet actuation profile is an axially extending taper.

7. The subsea connector assembly of claim 1, wherein the collet is a first collet, and the lock assembly includes a second collet engageable with the first portion of the wellhead member.

8. The subsea connector assembly of claim 1, wherein in the engaged position, the collet fingers are radially retracted.

9. The subsea connector assembly of claim 1, wherein in the disengaged position, the collet fingers are radially extended.

10. A method for coupling a spool member to a wellhead member via the subsea connector assembly of claim 1, comprising:

engaging the first portion of the wellhead member with the lock assembly of the connector; and engaging the second portion of the wellhead member that is spaced axially from the first portion with the plurality of collet fingers of the collet of the bending moment suppression device coupled to an end of the connector, wherein engaging the second portion includes moving the collet of the bending moment suppression device axially with respect to the housing of the bending moment suppression device to move the plurality of collet fingers of the collet into engagement with the second portion of the wellhead member.

11. The method of claim 10, wherein moving the collet of the bending moment suppression device comprises axially moving the collet with respect to the housing of the bending moment suppression device includes actuating the first actuator assembly to move the collet.

12. The method of claim 11, wherein:

the connector includes a second actuator assembly; and engaging the first portion of the wellhead member with the lock assembly includes actuating the second actuator assembly to engage the first portion of the wellhead member with the lock assembly.

13. The method of claim 12, wherein the first actuator assembly and the second actuator assembly are hydraulically operated and the first actuator assembly is fluidly independent from the second actuator assembly.

14. The method of claim 10 further comprising disengaging the plurality of collet fingers from the second portion of the wellhead member.

15. The method of claim 14, wherein disengaging the plurality of collet fingers from the second portion of the wellhead member includes lifting the housing to move the housing axially with respect to the collet along the collet actuation profile, wherein the collet actuation profile is an axially extending taper.

16. A subsea connector assembly for coupling a spool member to a wellhead member, comprising:

a connector including a lock assembly configured to engage a first portion of a wellhead member; and a bending moment suppression device coupled to the connector configured to engage a second portion of the wellhead member, wherein the second portion is spaced axially from the first portion, the bending moment suppression device including:

a housing including an inner surface defining a bore, the inner surface having a collet actuation profile;

a collet disposed in the bore of the housing, the collet including a plurality of collet fingers engaged with the collet actuation profile, wherein the collet is axially moveable relative to the housing within the bore to move the collet fingers along the collet actuation profile moving the plurality of collet fingers between a disengaged position and an engaged position, and wherein the collet fingers are radially retracted and engaged with the second portion of the wellhead member when in the engaged position; and a first actuator assembly configured to move the collet axially relative to the housing.

17. The subsea connector assembly of claim 16, wherein the bending moment suppression device is coupled to and extends from an end of the connector.

18. The subsea connector assembly of claim 16, wherein the connector further includes a second actuator assembly configured to actuate the lock assembly to engage the lock assembly with the first portion of the wellhead member.

19. The subsea connector assembly of claim 16, wherein the collet actuation profile is an axially extending taper.

20. The subsea connector assembly of claim 16, wherein in the disengaged position, the collet fingers are radially extended.

* * * * *